US005965220A

United States Patent [19]

Schöpping

[11] Patent Number: 5,965,220

[45] Date of Patent: Oct. 12, 1999

[54] INSTALLATION FOR COATING THE SURFACE OF A WEB WITH A PASTE

[75] Inventor: Gerhard Schöpping, Hemsbach, Germany

[73] Assignee: Firma Carl Freudenberg, Weinheim, Germany

[21] Appl. No.: 09/133,759

[22] Filed: Aug. 12, 1998

[30] Foreign Application Priority Data

Aug. 13, 1997 [DE] Germany ..... 197 350 26

[51] Int. Cl.[6] ..... B05D 1/26; B41L 13/04; B05C 1/10

[52] U.S. Cl. ..... 427/598; 427/282; 427/356; 101/116; 101/120; 492/8; 492/56; 118/126; 118/213; 118/406

[58] Field of Search ..... 101/116, 120; 492/8, 56; 118/249, 213, 406, 261, 126; 427/598, 356, 282

[56] References Cited

U.S. PATENT DOCUMENTS 4,290,353 9/1981 Pav et al. ..... 492/8
5,151,132 9/1992 Zimmer ..... 118/406

*Primary Examiner*—Katherine A. Bareford
*Attorney, Agent, or Firm*—Kenyon & Kenyon

[57] ABSTRACT

An installation for coating the surface of a web of material with a paste. A printing screen has a doctor blade lying within for applying the print paste through holes in the printing screen onto the web. A counter roll cooperates with an electromagnet to producing a controllable level of contact pressure of the doctor blade against the printing screen. The roll body of the counter roll is provided with a coating that has piezoelectric elements and is divided into sections specific to the width, each section being individually controllable. This permits dynamic control of the application of paste over the width of the web.

3 Claims, 3 Drawing Sheets

INSTALLATION FOR COATING THE SURFACE OF A WEB WITH A PASTE

TECHNICAL FIELD OF THE INVENTION

The invention relates to an installation for coating a surface-area material with a paste, in particular for coating nonwovens for inlay material with an adhesive. Among the uses to which such an installation may be put is printing.

BACKGROUND INFORMATION

Such installations are generally known, for example, in the manufacturing related arts. A web of material whose surface area is to be coated is passed between a printing screen and a counter roll that has been provided with an elastic cover. The paste is applied on the surface of the web through holes in the printing screen, which has a doctor blade lying within. Electromagnets are arranged in the counter roll to produce a level of contact pressure of the doctor blade against the printing screen.

The mass application of paste on the surface of the web can be controlled by way of the contact pressure of the doctor blade, at least within certain limits. The mass application in the transverse direction can be influenced by the doctor blade itself, given the use of a plurality of separately driven electromagnets.

However, there remains a need to provide finer control over the application of paste to the surface of a web in the transverse direction during the printing operation itself, so as to enhance the quality and efficiency of the production process.

SUMMARY OF THE INVENTION

The present invention meets these needs by providing on the roll body of the counter roll a coating that has piezoelectric elements arrayed by axially extending individual zones, each of a specific width, and each zone being controllable individually.

The thickness of a piezoelectric element changes in response to a change in the voltage applied to the piezoelectric element. By driving individual piezoelectric elements with a purposefully changed voltage during the printing process, a dynamic change in the contract pressure, and thus of the application of paste to the surface of a web, is achieved.

BRIEF DESCRIPTION OF THE DRAWINGS

The drawings illustrate an installation constructed according to the principles of the invention, in which a counter roll is provided with piezoelectric elements. In particular.

DETAILED DESCRIPTION OF THE INVENTION

Figure 1:
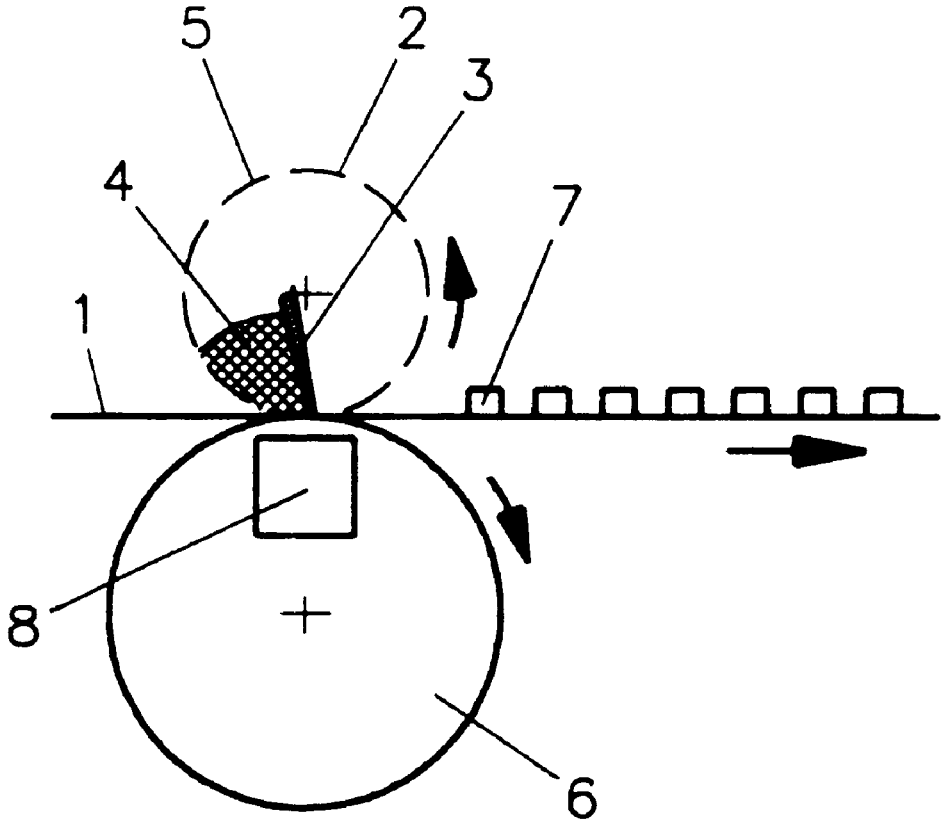
FIG. 1 is a schematic view of a printing installation for the application of a paste onto a nonwoven fabric.

FIG. 1 shows an installation (which may be used in printing) for coating the surface area of a web of material 1 with a paste 4. The printing installation features a printing screen 2 having doctor blade 3 lying within for applying a print paste 4 through holes 5 in printing screen 2 onto the surface-area of the web. The web 1 is passed through a nip between printing screen 2 and a counter roll 6. At this nip, paste 4 is applied to the web in the form of dots of paste 7, the result of the extrusion of paste through the holes 5.

To control the mass application of paste 4 in the transport direction of web 1, electromagnets 8 are provided to produce a contact pressure of doctor blade 3 against printing screen 2. These electromagnets 8 lie within counter roll 6 and pull doctor blade 3 over the entire width or over a partial area with of the counter roll 6, and provide a controllable level of magnetic force with which to attract the doctor blade.

Figure 2:
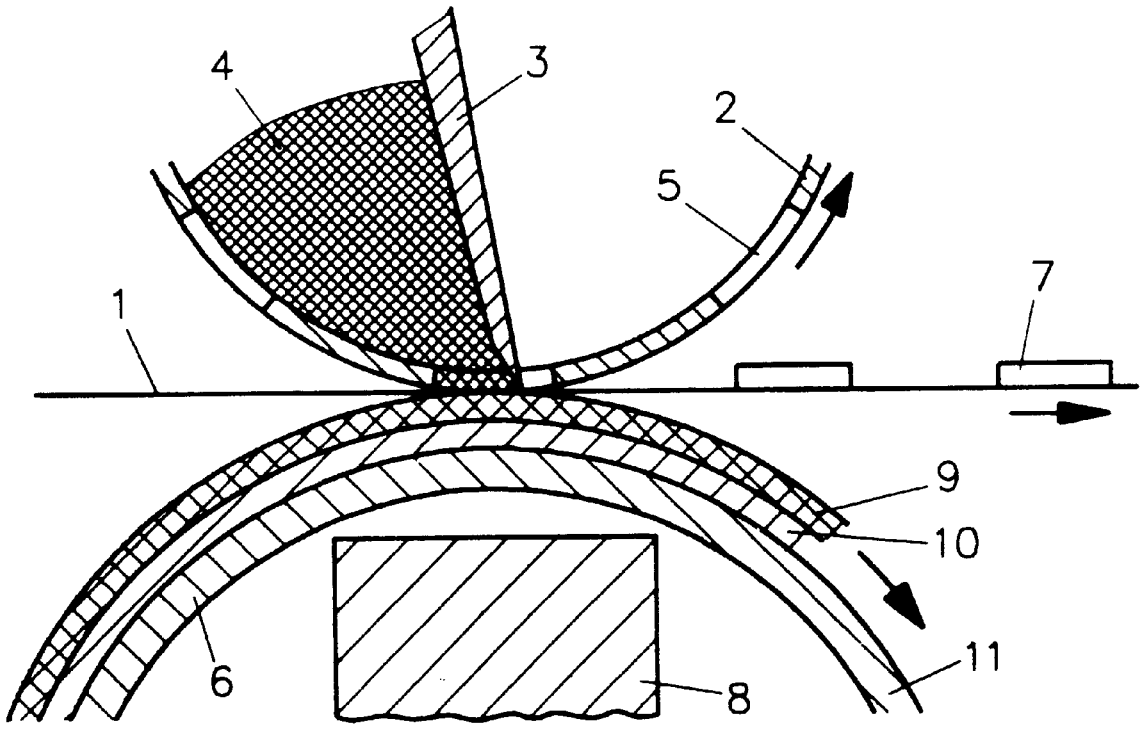
FIG. 2 is an enlarged cross-sectional view of an embodiment of a counter roll provided with piezoelectric elements.

Shown enlarged in FIG. 2 is the area where paste 4 is applied. Counter roll 6 is provided with a cover 9 of elastic material such as silicone, along which surface-area material 1 is guided. Under cover 9, a coating 10 having piezoelectric elements is secured on wall 11 of the counter roll 6. A specific thickness of the piezoelectric element adjusts as a function of the magnitude of the electric voltage applied to the piezoelectric element.

Due to this purposeful change in the roll geometry because of the piezoelectric effect, the application of paste can be changed in the transverse direction as well.

Figure 3:
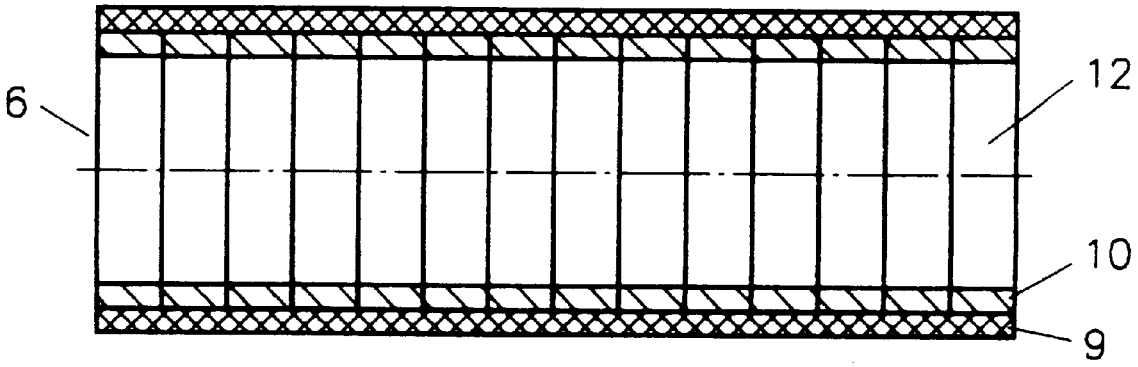
FIG. 3 is an axially extending sectional view of the counter roll showing the arrangement of piezoelectric elements and their elastic overlay, minus the interiorly located roll body.

FIG. 3 shows an axial section taken along the longitudinal axis of the counter roll 6, minus the interior wall 11. Distributed over the axial width of counter roll 6 are individual sections 12 of coating 10 having piezoelectric elements, the sections being covered by an elastic cover 9. Each individual section 12 is controllable, independently of the others, via independently addressable electric lines (not shown), by which a voltage can be applied to each section 12 to provide a carefully metered variation in the thickness of the counter roll 6. Hence, cover 9 of elastic material renders possible the compensation of the variable, local change in thickness of coating 10 at the surface of counter roll 6.

Using the installation of the present invention, a paste can be applied while cold onto the surface of non-woven fabric linings. The present invention permits the fine adjustment of the application of the paste in the transverse and longitudinal direction, so as to provide a coating of uniform distribution, as desired.

What is claimed is:

1. A method for altering contact pressure exerted on a web at a nip between a printing screen and a counter roll, comprising the steps of:

feeding a quantity of paste to the interior of a printing screen having holes on its surface;

extruding paste through the holes onto a surface of the web along the nip defined by the printing screen and a counter roll;

energizing an electromagnet within the counter roll to selectively urge a doctor blade located within the printing screen towards the counter roll; and selectively energizing an axially extending array of piezoelectric elements located along the axial extent of the counter roll so that a fine degree of control over the radial dimension of that portion of the counter roll associated with the piezoelectric elements can be attained, thereby altering the contact pressure provided by the nip on the web.

2. An installation for coating a surface of a web of material with paste, comprising:

a printing screen having an outer surface that has holes, the printing screen containing therewithin a doctor blade for the application of paste through the holes in the printing screen onto the surface of the web; and an axially extending counter roll containing means for producing a contact pressure of the doctor blade against the printing screen, the counter roll comprising a roll body, and a coating on the roll body having separately addressable piezoelectric elements that are arrayed along the axial extent of the counter roll;

wherein the geometry of the counter roll can be adjusted by the piezoelectric elements.

3. An installation as set forth in claim 2, wherein the means for producing contact pressure of the doctor blade against the counter roll is an electromagnet contained within the counter roll.

* * * * *